US005357325A

United States Patent [19]

Kawaguchi

[11] Patent Number: 5,357,325

[45] Date of Patent: Oct. 18, 1994

[54] IMAGE FORMING APPARATUS HAVING TRANSFER MEMBER ROTATING FASTER THAN IMAGE BEARING MEMBER

[75] Inventor: Hideshi Kawaguchi, Yokohama, Japan

[73] Assignee: Canon Kabushiki Kaisha, Tokyo, Japan

[21] Appl. No.: 652,222

[22] Filed: Feb. 6, 1991

Related U.S. Application Data

[63] Continuation of Ser. No. 301,475, Jan. 26, 1989, abandoned.

[30] Foreign Application Priority Data

Jan. 30, 1988 [JP] Japan ..... 63-021633

[51] Int. Cl.[5] ..... G03G 15/00

[52] U.S. Cl. ..... 355/277; 355/271

[58] Field of Search ..... 355/271, 272, 274, 275, 355/277–281, 326, 327, 282, 285

[56] References Cited

U.S. PATENT DOCUMENTS

| | | | |
|---|---|---|---|
| 3,957,367 | 5/1976 | Goel | 355/271 X |
| 4,326,792 | 4/1982 | Landa | 355/277 |
| 4,380,385 | 4/1983 | Ozaki et al. | 355/277 |
| 4,403,847 | 9/1983 | Chrestensen | 355/277 |
| 4,605,298 | 8/1986 | Russel et al. | 355/271 |
| 4,733,269 | 3/1988 | Kasahara et al. | 355/271 X |
| 4,739,361 | 4/1988 | Roy et al. | 355/277 |
| 4,788,574 | 11/1988 | Matsumoto et al. | 355/326 |
| 4,894,687 | 1/1990 | Beaudet | 355/277 |

FOREIGN PATENT DOCUMENTS

| | | | |
|---|---|---|---|
| 2426176A1 | of 1975 | Fed. Rep. of Germany . | |
| 56-119166 | of 1981 | Japan . | |
| 56-126872 | 10/1981 | Japan . | |
| 58-72955 | of 1983 | Japan . | |
| 58-187967 | of 1983 | Japan . | |
| 0028983 | 2/1986 | Japan | 355/277 |
| 0229763 | 10/1986 | Japan | 355/282 |
| 0100777 | 5/1987 | Japan | 355/277 |

OTHER PUBLICATIONS

U.S. Ser. No. 156592, Filed on, Feb. 17, 1988, by Ichiro Ohsawa et al.

*Primary Examiner*—R. L. Moses
*Assistant Examiner*—Robert Beatty
*Attorney, Agent, or Firm*—Fitzpatrick, Cella, Harper & Scinto

[57] ABSTRACT

An image forming apparatus having an image bearing member for carrying an image, a transfer member for urging a recording sheet against the image bearing member and transferring an image onto the recording sheet, a driving means for rotationally driving the image bearing member, and a driving force transmission means for transmitting a driving force from the driving means to the transfer member through the image bearing member. The transfer member is then rotated so that the peripheral speed of a portion of the transfer member which urges the sheet against the image bearing member is higher than the peripheral speed of the image bearing member. The image forming apparatus satisfies the following inequality: $R_D W_D < R^1 W_T$, where $R_D$ is the radius of the image bearing member, $R^1$ is the minimum radius of the transfer member, $W_D$ is the angular velocity of the image bearing member and $W_T$ is the angular velocity of the transfer member.

31 Claims, 8 Drawing Sheets

IMAGE FORMING APPARATUS HAVING TRANSFER MEMBER ROTATING FASTER THAN IMAGE BEARING MEMBER

This application is a continuation of application Ser. No. 301,475 filed Jan. 26, 1989, now abandoned.

BACKGROUND OF THE INVENTION

1. Field of the Invention

The present invention relates to an image forming apparatus used with copying machines, laser beam printers and the like, and, more particularly, it relates to an image forming apparatus including an image bearing member (referred to as "photosensitive drum" hereinafter) and a transfer roller.

2. Related Background Art

In a conventional image forming apparatus including a photosensitive drum or exposure drum and a transfer roller, for example, as shown in FIGS. 10 and 11, a transfer roller 26 made of elastic material is pressed against a photosensitive drum 22 by a spring 6, and a toner image formed on the photosensitive drum 22 is transferred to a recording sheet carried by the transfer roller 26 by applying a bias voltage to the transfer roller 26. In this case, a portion **26*b* of the transfer roller 26 (referred to as "contacting portion" hereinafter) which is being pressed against the photosensitive drum 22 will be gradually deformed and be decreased in its diameter, with the result that the peripheral speed of the contacting portion 26*b* of the transfer roller 26 will be slower than that of the other portions of the transfer roller 26**.

In order to avoid such inconvenience, as disclosed in the Japanese Patent Laid-Open No. 56-126872, transfer roller 26 was driven independently of the photosensitive drum 22 so that the peripheral speed of the contacting portion **26*b* was equal to that of the photosensitive drum 22. More particularly, transfer roller 26 was driven by a discrete driving means different from the driving means for driving the photosensitive drum 22, in such a manner that the peripheral speed of a point situated on the contacting portion 26*b* of the transfer roller 26, which has the smallest diameter, was the same as the peripheral speed of the photosensitive drum 22 and the peripheral speed of the other portion of the transfer roller 26 was higher than that of the photosensitive drum 22**.

So long as either photosensitive drum 22 or transfer roller 26 is subjected to a driving force, the other can be driven by the same driving force. In this case, as shown in FIG. 14, even if a gear 17 of the photosensitive drum 22 is not actually engaged with a driving gear 16 (of the driving means for driving the photosensitive drum 22), the photosensitive drum 22 is rotated by a rotational force $F_T$ (FIG. 13) caused by contacting transfer roller 26.

On the other hand, when the photosensitive drum 22 and transfer roller 26 are drivingly rotated by driving both of these elements 22, 26 by means of respective driving means, so that the peripheral speed of the portion, having the smallest diameter, of the contacting portion **26*b* of the transfer roller 26 is higher than the peripheral speed of the photosensitive drum 22, as shown in FIG. 15, the transfer roller 26 is subjected to a driving force $f_2$ from the driving means through a driving gear 14 (of the driving means) and a gear 15 (of the transfer roller) and to a resistance force $F_D$ for resisting the rotation of the transfer roller 26 caused by the photosensitive drum 22. While the photosensitive drum 22 is subjected to the rotational force $F_T$ tending to accelerate the rotation of the photosensitive drum 22 caused by the transfer roller 26, and at the same time, is subjected to a rotational force $f_3$ tending to decelerate the rotation of the photosensitive drum 22 from the associated driving means through gears 16 and 17. In this case, when the driving force $f_3$ is not transmitted to the photosensitive drum 22 from the driving gear 16 of the driving means (i.e., a tooth of the gear 16 is not engaged by a tooth of the gear 17 or the photosensitive drum is subjected to the force tending to resist the rotation thereof), if a leading edge of a recording sheet S is struck against a fixing device (not shown), a shock or impact force will be transmitted to the photosensitive drum 22 and transfer roller 26 through the recording sheet S, thereby returning the photosensitive drum 22 to a position shown by a dotted line (FIG. 15). Then the tooth of gear 17 of the photosensitive drum 22 is contacted to the tooth of driving gear 16, thus stopping or decelerating the photosensitive drum 22 temporarily. Thereafter, photosensitive drum 22 is rotated at a normal speed by the driving force $f_1$ (FIG. 12) from the driving gear 16. Accordingly, in such a case, there arises a problem that an image transferred to the transfer roller 26 is distorted or sheared due to the uneven rotation of the photosensitive drum 22**. Such problem will also arise in the case where a sheet conveying path is curved downstream of the image transfer position, since the sheet is subjected to a variable friction force by such a curved path.

SUMMARY OF THE INVENTION

It is an object of the present invention to provide an image forming apparatus which can obtain a clear or distinct image without distortion and/or shear.

In order to achieve the above object, an image forming apparatus according to the present invention uses an image carrying member for carrying an image, a rotating member for urging a recording sheet against the image bearing member, a driving means for rotationally driving the image bearing member, and a driving force transmission means for transmitting a driving force from the driving means to the rotating member through the image bearing member. The rotating member is rotated so that the peripheral speed of a portion of the rotating member that urges the sheet against the image bearing member is higher than the peripheral speed of the image bearing member.

DETAILED DESCRIPTION OF THE PREFERRED EMBODIMENTS

The present invention will now be explained with reference to the accompanying drawings, wherein the present invention is applied to a laser beam printer.

Figure 2:
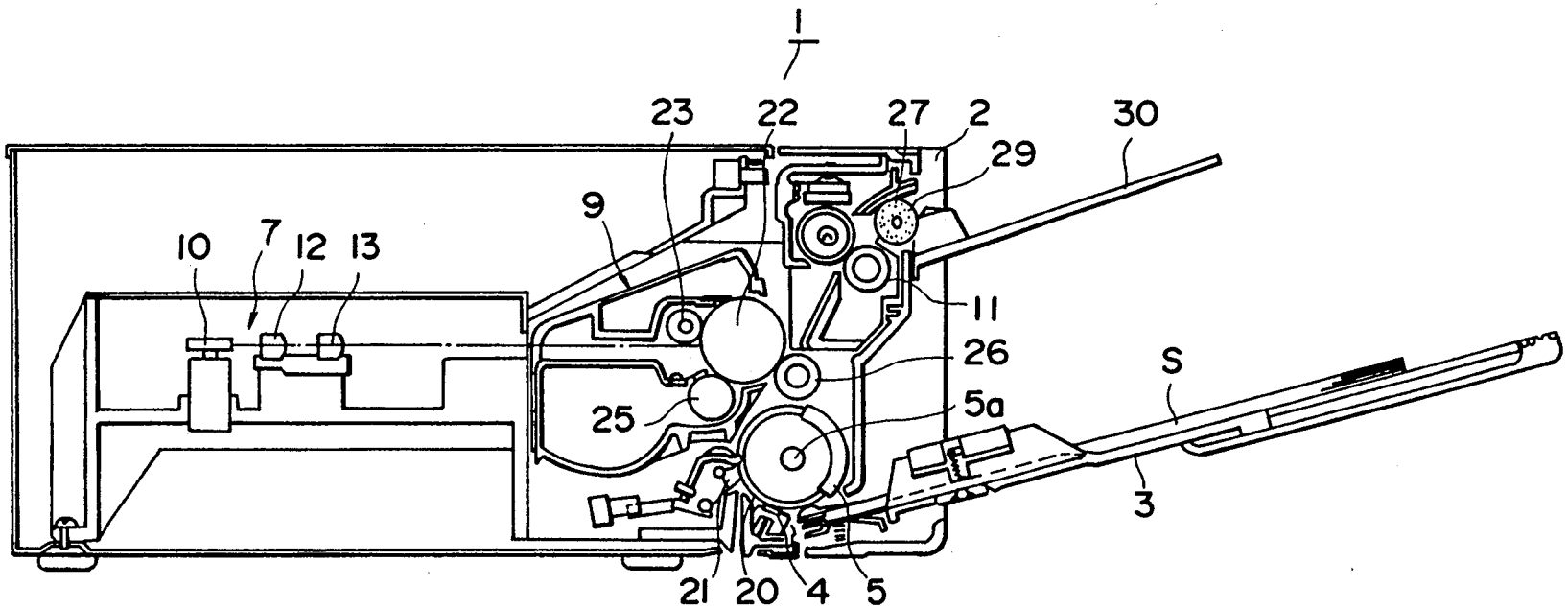
FIG. 2 is a sectional elevational view of the image forming apparatus according to the present invention.
Figure 3:
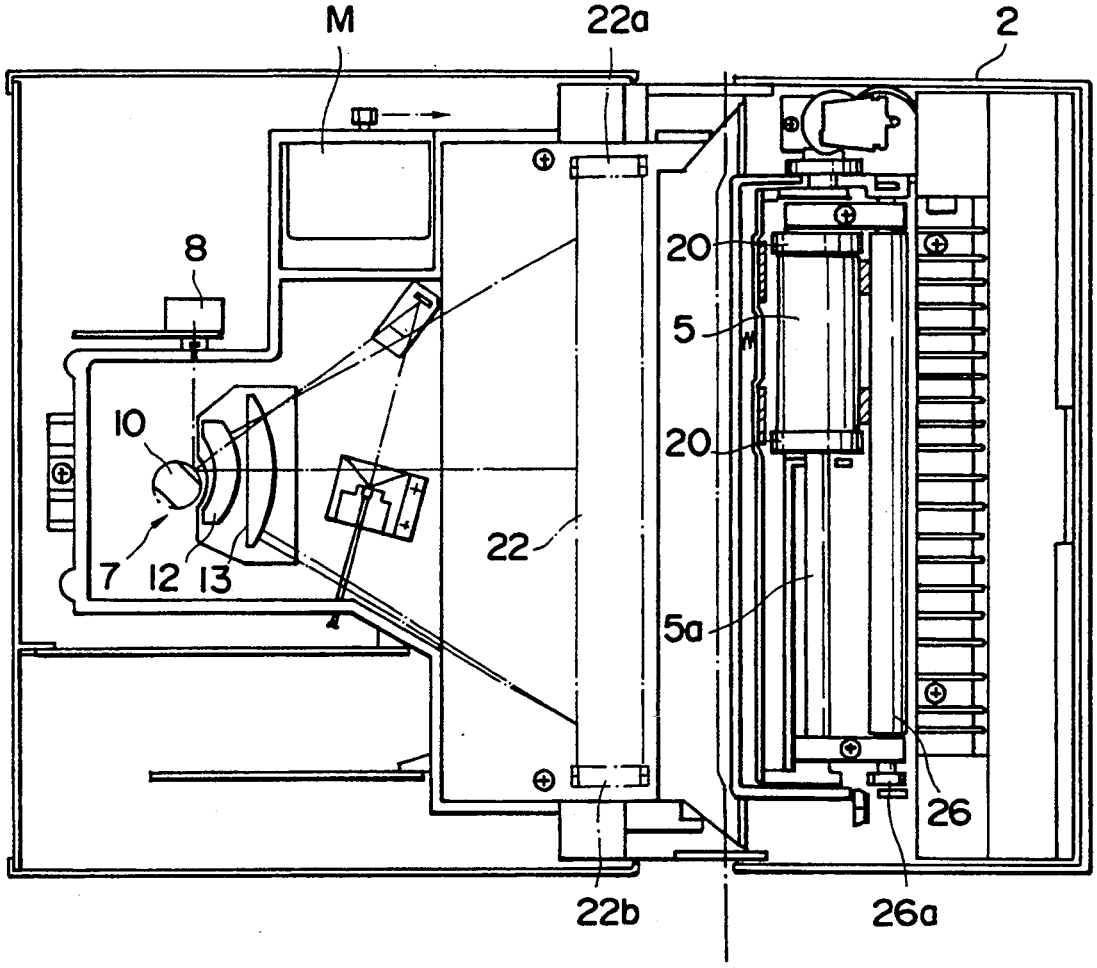
FIG. 3 is a sectional plan view of the apparatus of FIG. 2.
Figure 4:
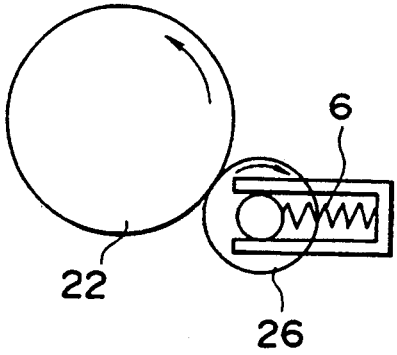
FIG. 4 is an end view showing an essential part of the image forming apparatus according to the present invention.

As shown in FIGS. 2 to 4, a laser beam printer 1 includes a sheet supply tray 3 which protrudes from a frame 2 of the printer and on which a plurality of sheets S is stacked, a sheet separating pad 4 for separating a single sheet S from the sheet stack and a sheet feed roller 5 for feeding the separated sheet sheets one by one to the printer are arranged near an inner end of the supply tray 3. Auxiliary rollers 20 freely and rotatably supported on shaft 5*a* of feed roller 5 are arranged to abut against the separating pad 4 when the sheet is not fed by feed roller 5. Further, a sheet conveying roller 21 is pressed against the auxiliary rollers 20 downstream of the separating pad 4 and is connected to a motor M through an appropriate gear train (not shown).

An image forming portion or station 9, arranged downstream of sheet conveying roller 21, can form an image using a laser signal from a laser scanner portion 7 for modulating a laser beam emitted by a laser generator 8. The image forming station 9 includes a charging roller 23 arranged around a photosensitive drum 22 for charging the photosensitive drum 22, a developer unit 25, and a transfer roller 26 pressed against the photosensitive drum 22 by means of a spring 6. Transfer roller 26 is constituted by a cylindrical metallic body, and a sponge layer covering the peripheral surface of the metallic body and made of silicone oxide mixed with electric conductive material therein. Thus, a portion of transfer roller 26 pressed against the photosensitive drum 22, can be elastically deformed.

Downstream of the image forming station 9 there is a fixing device 11, downstream of which a sheet ejector guide 27 and a sheet ejector sponge roller 29, which cooperates with the ejector guide 27 to pinch the sheet, therebetween and eject the sheet are arranged. Downstream of the ejector roller 29, there is arranged a sheet receiving tray 30 for collecting the sheets having the image thereon with the imaged surface up. The above-mentioned laser scanner portion 7 is constituted by a polygonal mirror 10, a spherical lens 12 and a F$\theta$ lens 13.

Figure 1A:
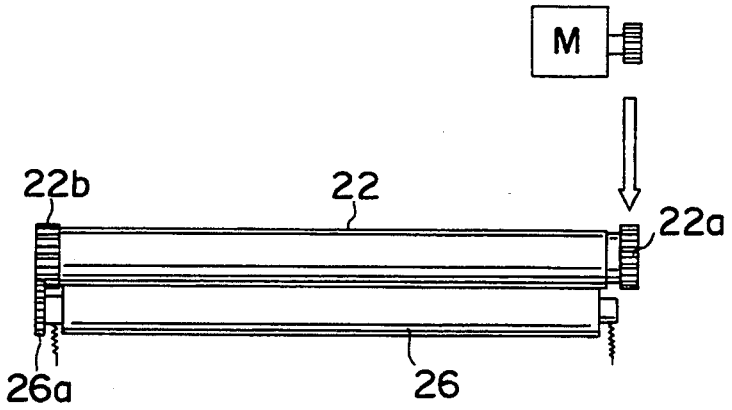
FIG. 1A is a plan view of an essential part of an image forming apparatus according to the present invention.

As shown in FIG. 1A, driving power from the above-mentioned motor M is transmitted to a driving gear 22*a* through an appropriate gear train (not shown). The photosensitive drum 22 is then rotated integrally with driving gear 22*a*. The rotational force of photosensitive drum 22 is then transmitted to the transfer roller 26 through a gear 22*b* fixed to the photosensitive drum 22 and a driving gear 26A for transfer roller 26, thereby rotating transfer roller 26.

Figure 1B:
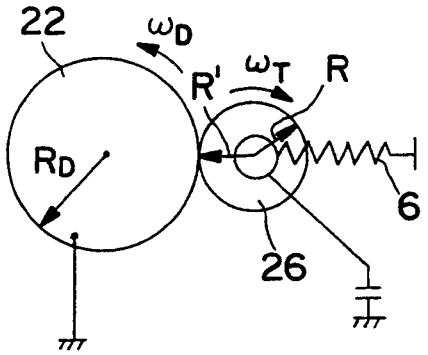
FIG. 1B is an end view of the apparatus of FIG. 1A.

As shown in FIG. 1B, if the minimum radius of the portion of transfer roller 26 pressed against photosensitive drum 22 (i.e., the depressed portion deformed by contacting the exposure drum) is R', the radius of the remaining portion of the transfer roller 26 is R, the radius of the photosensitive drum 22 is $R_D$, the angular velocity of the photosensitive drum is $\omega_D$, and the angular velocity of transfer roller 26 is $\omega_T$, the relationship between gear 22*b* and the driving gear 26A (FIG. 1A) is so selected as to meet the following requirements:

$$R_D\omega_D < R'\omega_T$$

Figure 6:
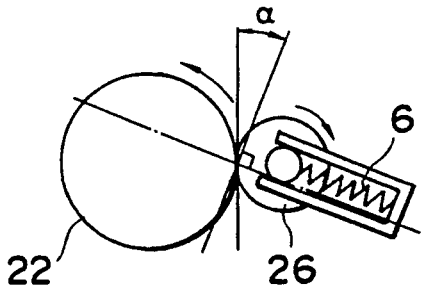

In this case, a difference between the value $R_D\omega_D$ and the value $R'\omega_T$ is selected to be in a range such that the difference does not have a bad influence upon the transferring of the image. For example, the system may be designed so that the diameter of the transfer roller 26 is 16.2 mm, the diameter of the photosensitive drum 22 is 30 mm, the contacting pressure between the drum 22 and roller 26 is 600 grams, the number of teeth on gear 22*b* is 50, the number of teeth on driving gear 26*a* is 26, with modules of these gears being 1, a profile shift of driving gear 22*a* is −0.1, hardness of driving gear 22*a* is lower than 40° in Masker hardness, preferably 25°–30°, and transfer roller 26 is made of urethane foam material. In addition, the outer peripheral surface of the transfer roller 26 is normally polished to obtain a desired outer diameter thereof. Further, the direction in which the transfer roller 26 is biased by means of spring 6 is perpendicular to a line offset by pressure angle $\alpha$ from a tangential line passing through the point at which transfer roller 26 and photosensitive drum 22 come into contact; (refer to FIG. 6).

In the embodiment mentioned above, when an image signal is applied to laser beam printer 1 from an appropriate external apparatus (not shown), an image based on the image signal from the external apparatus is formed in the image forming station 9 through laser scanner portion 7. In this case, only the uppermost recording sheet S of the sheet stack in the supply tray 3 is separated from the sheet stack and picked up by the separating pad 4 and feed roller 5. This recording sheet S is then conveyed by auxiliary rollers 20 and conveying roller 21 in synchronism with the image being formed in the image forming station 9. After the image is printed on the recording sheet S in the image forming station 9, the recording sheet is then conveyed to fixing device 11 by the conveying action of photosensitive drum 22 and transfer roller 26.

Figure 5A:
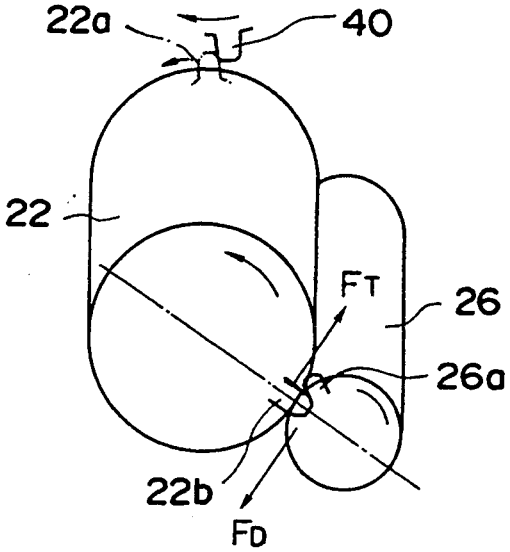
FIGS. 5A, 5B and 6 are explanatory views showing an operation of the image forming apparatus according to the present invention.
Figure 5B:
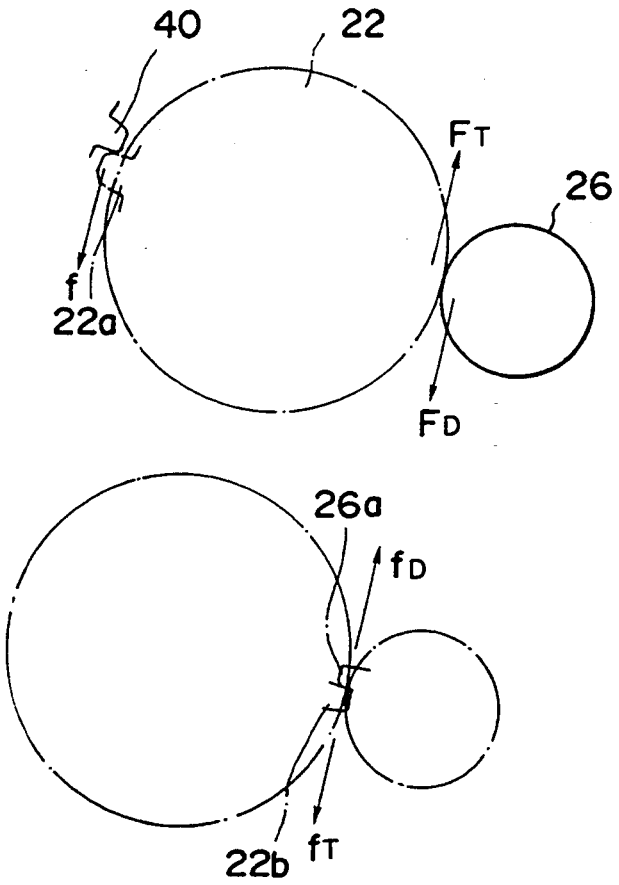

In the illustrated embodiment, as shown in FIGS. 5A and 5B, since the driving force for driving the photosensitive drum 22 and transfer roller 26 is obtained by a force f, shown in FIG. 5B, transmitted from a gear 40 to the driving gear 22*a*, gear 40 and driving gear 22*a* must always be engaged with each other (if these gears are disengaged from each other the driving force cannot be transmitted). Further, transfer roller 26 is rotated while slipping on the photosensitive drum 22, and, accordingly, transfer roller 26 is subjected to, from photosensitive drum 22, a resistance force $F_D$ for resisting the rotation of the roller. On the other hand, to counteract this resistance force $F_D$, the driving gear 26*a* is subjected to a force $f_D$ by continuously engaging with the gear 22*b* which is rotated integrally with photosensitive drum 22. Therefore, if gears 26*a* and 22*b* are not engaged with each other, roller 26 cannot be rotated faster than photosensitive drum 22.

Incidentally, since the outer surface of transfer roller 26 is constituted by a sponge layer made of silicone oxide to have high elasticity, as stated above, even when transfer roller 26 is rotated while slipping on the photosensitive drum 22, the outer surface of the photosensitive drum 22 is not affected adversely by such slipping movement.

As shown in FIG. 5B, there is an image transfer operation where an image on the image bearing member 22 is transferred onto a sheet in the nip between the image bearing member 22 and rotating member 26. By setting the peripheral speed of the nip portion of rotating member 26 to be larger than the peripheral speed of the nip portion of image bearing member 22, the image bearing member 22 receives the first force $F_T$ in rotating direction of the image bearing member 26. This force $F_T$ operates to disengage engagement between the gear 22*a* (first drive force transmitting means) and the gear 40 (driving means). This disengagement would normally result in image vibration due to shock generated when tip end of the sheet under transferring enters into fixing means. However, this is avoided by the application to gear 22 of a second force $f_T$ in a direction reverse to the direction of force $F_T$ from the gear 26*a* (second drive force transmitting means).

Accordingly, during the printing operation, even if the leading edge of the recording sheet S is struck against the fixing device 11, generating the shock or impact force, the photosensitive drum 22 and the transfer roller 26 can be rotated at a constant speed, thus preventing distortion and/or shear of the image. In fixing device 11, the image is fixed on the recording sheet S; thereafter, sheet S is ejected on to the sheet receiving tray 30 with the imaged surface thereof up. Further, when the sheet conveying path is curved, even if the sheet is subjected to the impact force from the curved path, distortion and/or shear of the image can be effectively prevented for the reasons mentioned above.

Figure 7:
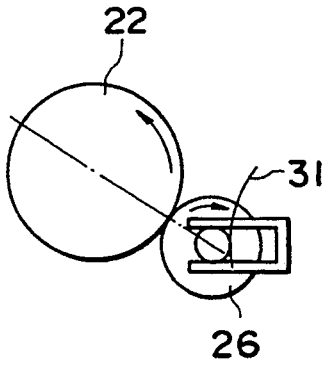
FIGS. 7, 8 and 9 show other embodiments of the present invention.
Figure 8:
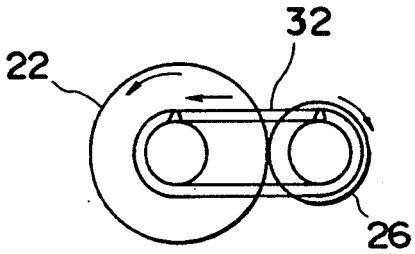
Figure 9:
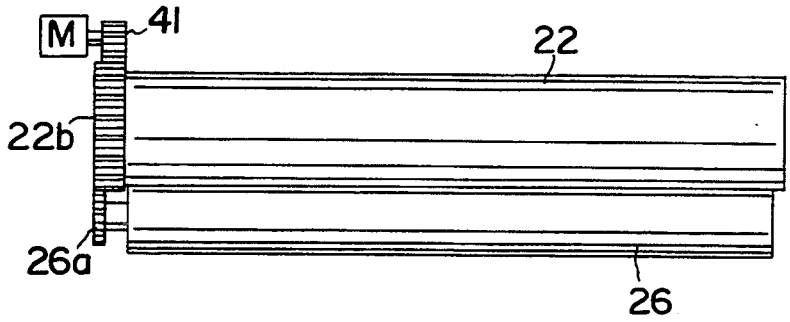
Figure 10:
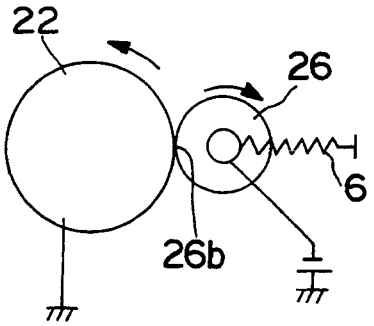
FIG. 10 PRIOR ART
FIGS. 10, 11, 12, 13, 14 and 15 show an example of a conventional image forming apparatus.
Figure 11:
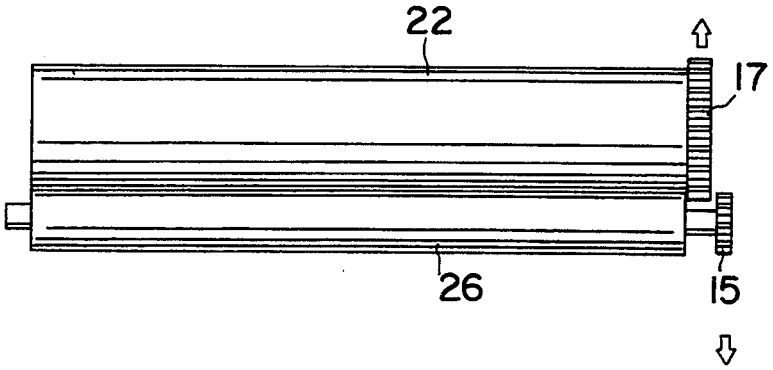
FIG. 11 PRIOR ART
Figure 12:
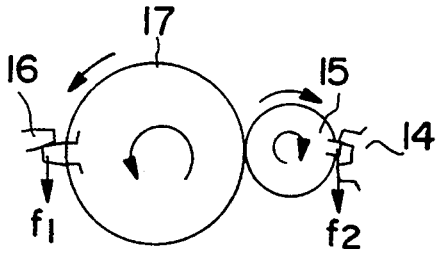
FIG. 12 PRIOR ART
Figure 13:
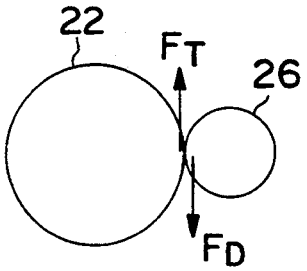
FIG. 13 PRIOR ART
Figure 14:
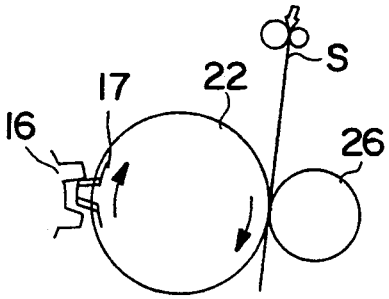
FIG. 14 PRIOR ART
Figure 15:
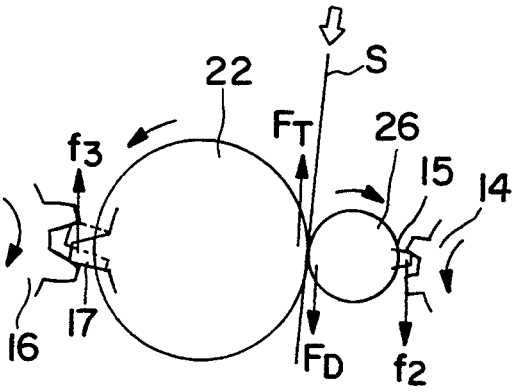
FIG. 15 PRIOR ART

Incidentally, in the illustrated embodiment, while an example of the transfer roller 26 being pressed against the photosensitive drum 22 by means of spring 6 was explained, the present invention is not limited to such an example; transfer roller 26 may, for example, be biased toward the photosensitive drum 22 by means of a leaf spring 31, as shown in FIG. 7. Further, in the illustrated embodiment, while an example of the driving force being transmitted from the photosensitive drum 22 to the transfer roller 26 through the gear 22*b* and driving gear 26*a* was explained, the present invention is not limited to such an example; such driving force may, for example, be transmitted through a wrapping connector 32 such as a belt, chain and the like, as shown in FIG. 8. In addition, in the illustrated embodiment, while an example of the rotational force from the motor M being transmitted to the driving gear 22*a* through the gear train (not shown) was explained, it should be noted that the present invention is not limited to such an example; photosensitive drum 22 may be driven by a gear 41 directly coupled to an output shaft of the motor M and meshed with gear 22*b* of the photosensitive drum 22, as shown in FIG. 9.

Further, by orienting the direction in which transfer roller 26 is pressed against photosensitive drum 22 to a direction substantially perpendicular to the direction of the pressure angle between the gear 22*b* and the driving gear 26*a*, any force other than the driving force transmitted between the gears 22*b* and 26*a* can effectively be prevented from acting on the gears. In addition, since the force acting between gear 22*b* and driving gear 26*a* almost not affect does the influence upon the bias force by which the transfer roller 26 is pressed against the photosensitive drum 22, transfer roller 26 is biased toward the photosensitive drum 22 substantially by the force of spring 6 alone. Consequently, if the transfer roller 26 is drivingly rotated, the bias force is kept constant, thus permitting the stable transferring of the image and preventing deviation of the transfer roller 26 from its original position due to the force acting on the driving gear 26*a* of the transfer roller 26 from gear 22*b* of the photosensitive drum 22.

Lastly, in the illustrated embodiments, while the photosensitive drum 22 was used as the image bearing member, it should be noted that the image bearing member is not limited to a photosensitive drum, but may be constituted by a photosensitive belt and the like. Further, in place of the transfer roller 26, another rotating member such as a belt pressed against the image bearing member may be used. Also, in this case, a sponge layer made of silicone oxide mixed with electric conductive material therein is disposed on an outer surface of the belt-shaped rotating member.

I claim:

1. An image forming apparatus comprising:

an image bearing member rotatably disposed;

a rotating member for biasing a sheet against said image bearing member, said rotating member transferring, at a nip portion between said image bearing member and said rotating member, an image on said image bearing member onto the sheet;

drive force transmitting means for transmitting a drive force from a drive means to said image bearing member;

a first gear provided on said image bearing member;

a second gear provided on said rotating member, said second gear engaging with said first gear and the drive force being transmitted from said first gear to said second gear;

a pair of rotary feeding members disposed downstream of said rotating member in the sheet moving direction, wherein the distance from a nip portion between said image bearing member and said rotating member to a nip portion between said pair of rotary feeding member is set shorter than the length of the sheet;

wherein upon image transfer, a peripheral speed of a nip portion of said rotating member is set larger than a peripheral speed of a nip portion of said image bearing member such that the image bearing member will receive a first force in a rotating direction thereof from said rotating member, said first gear receiving a second force in a direction opposite to the first force from said second gear when transferring the image;

wherein said image forming apparatus satisfies the following inequality: $R_D\omega_D < R'\omega_T$, where $R_D$ is the radius of said image bearing member, $R'$ is the minimum radius of said rotating member, $\omega_D$ is the angular velocity of said image bearing member, and $\omega_T$ is the angular velocity of said rotating member.

2. An image forming apparatus according to claim 1, wherein said image bearing member and rotating member are both rotated with a slipping movement therebetween.

3. An image forming apparatus according to claim 1, wherein said drive force transmitting means has a driving gear and a third gear provided on said image bearing member to engage with said driving gear and the drive force from said driving means is transmitted from said driving gear to said third gear.

4. An image forming apparatus according to claim 1, wherein said drive force transmitting means has a driving gear to engage with said first gear, the drive force from said driving means being transmitted from said driving gear to said first gear.

5. An image forming apparatus according to claim 1, wherein said rotating member has resiliency.

6. An image forming apparatus according to claim 1, wherein said image bearing member is a photosensitive member.

7. An image forming apparatus according to claim 1, wherein said image bearing member has a drum-like shape.

8. An image forming apparatus according to claim 1, wherein said image bearing member has a belt-like shape.

9. An image forming apparatus according to claim 1, wherein said rotating member has a belt-like shape.

10. An image bearing apparatus according to claim 1, wherein said rotating member has a roller-like shape.

11. An image forming apparatus according to claim 1, wherein said paired rotary feeding members fix the image, which is transferred onto the sheet, to the sheet.

12. An image forming apparatus according to claim 1, further including biasing means for biasing said rotating member against said image bearing member in a direction orthogonal to a linear line offset by a pressure angle between said first and second gears from a tangential line passing through the point where said image bearing member and rotating member are brought into contact each other.

13. An image forming apparatus according to claim 5, wherein said rotating member has a sponge layer.

14. An image forming apparatus according to claim 1, wherein the second force maintains said drive means and said drive force transmitting means in an engaged state.

15. An image forming apparatus according to claim 1, wherein voltage is biased between said image bearing member and rotating member for transferring.

16. An apparatus according to claim 12, wherein said biasing means is a spring.

17. An apparatus according to claim 3 or 4, wherein said first gear receives the second force from said second gear so as to maintain the engagement between said third gear and said drive gear.

18. An apparatus according to claim 1, wherein said second force is a force in a direction opposite to a rotational direction of said image bearing member.

19. An image forming apparatus according to claim 1, wherein said pair of rotary feeding members fix the image transferred onto the sheet.

20. An image forming apparatus according to claim 1, wherein said first gear comprises a plurality of first gear teeth and said second gear comprises a plurality of second gear teeth, and wherein a second force received by said first gear causes at least one of said plurality of first gear teeth to continuously engage at least one of said plurality of second gear teeth.

21. An image forming apparatus comprising:

an image bearing member rotatably disposed;

a rotating member for biasing a sheet against said image bearing member, said rotating member transferring, at a nip portion between said image bearing member and said rotating member, an image on said image bearing member onto the sheet;

drive force transmitting means for transmitting a drive force from a drive means to said image bearing member;

a first gear provided on said image bearing member;

a second gear provided on said rotating member, said second gear engaging with said first gear;

a pair of rotary feeding members disposed downstream of said rotating member in the sheet moving direction, wherein the distance from a nip portion between said image bearing member and said rotating member to a nip portion between said pair of rotary feeding members is shorter than the length of the sheet; and biasing means for biasing said rotating member against said image bearing member in a direction orthogonal to a linear line offset by a pressure angle between said first and second gears from a tangential line passing through the point where said image bearing member and said rotating member are brought in to contact with each other;

wherein said image forming apparatus satisfies the following inequality: $R_D\omega_D < R'\omega_T$, where $R_D$ is the radius of said image bearing member, $R'$ is the minimum radius of said rotating member, $\omega_D$ is the angular velocity of said image bearing member, and $\omega_T$ is the angular velocity of said rotating member.

22. An apparatus according to claim 21, wherein a peripheral speed of said rotating member is larger than that of said image bearing member at said nip portion when transferring the image.

23. An apparatus according to claim 21, wherein said apparatus has a drive force transmitting means for transmitting the drive force from said driving means to said image bearing member.

24. An apparatus according to claim 23, wherein said drive force transmitting means has a driving gear and a third gear provided on said image bearing member to engage with said driving gear and the drive force from said driving means is transmitted from said driving gear to said third gear.

25. An apparatus according to claim 23, wherein said drive force transmitting means has a driving gear to engage with said first gear, the drive force from said driving means being transmitted from said driving gear to said first gear.

26. An apparatus according to claim 21, wherein said rotating member has resiliency.

27. An apparatus according to claim 21, wherein said image bearing member is a photosensitive member.

28. An apparatus according to claim 26, wherein said rotating member has resiliency.

29. An apparatus according to claim 21, wherein voltage is biased between said image bearing member and said rotating member for transferring said image.

30. An image forming apparatus according to claim 21, wherein said pair of rotary feeding members fix the image transferred onto the sheet.

31. An image forming apparatus according to claim 21, wherein said first gear comprises a plurality of first gear teeth, wherein said second gear comprises a plurality of second gear teeth, and wherein a second force received by said first gear causes at least one of said plurality of first gear teeth to continuously engage at least one of said plurality of second gear teeth.

* * * * *

UNITED STATES PATENT AND TRADEMARK OFFICE

CERTIFICATE OF CORRECTION

PATENT NO. : 5,357,325
DATED : October 18, 1994
INVENTOR(S) : HIDESHI KAWAGUCHI

It is certified that error appears in the above-indentified patent and that said Letters Patent is hereby corrected as shown below: On the title page, item:

[56] References Cited
line FPD, "2426176A1 of 1975 Fed. Rep. of Germany" should read --2426176A1 1/1975 Fed. Rep. of Germany--;
line FPD, "56-119166 of 1981 Japan" should read --56-119166 9/1981 Japan--;
line FPD, "58-72955 of 1983 Japan" should read --58-72955 5/1983 Japan";
line FPD, "58-187967 of 1983 Japan" should read --58-187967 11/1983 Japan--; and
line FPD, "0028983 2/1986 Japan" should read --61-28983 2/1986 Japan";
line FPD, "0229763 10/1986 Japan" should read --61-229763 10/1986 Japan; and
line FPD, "0100777 5/1987 Japan" should read --62-100777 5/1987 Japan--.

Column 2,
line 18, "a" should read --the--.

Column 3,
line 12, "sheet" should be deleted.

Column 5,
line 58, "not affect does" should read --does not affect--.

Column 6,
line 33, "member" should read --members,--.

Signed and Sealed this
Seventh Day of March, 1995

Bruce Lehman

*Attest:*

BRUCE LEHMAN

*Attesting Officer*

*Commissioner of Patents and Trademarks*